US008365448B2

(12) United States Patent
Gorham, Jr.

(10) Patent No.: US 8,365,448 B2
(45) Date of Patent: Feb. 5, 2013

(54) MEMORIAL DISPLAY

(76) Inventor: James H. Gorham, Jr., Chesapeake, VA (US)

( * ) Notice: Subject to any disclaimer, the term of this patent is extended or adjusted under 35 U.S.C. 154(b) by 53 days.

(21) Appl. No.: 13/163,556

(22) Filed: Jun. 17, 2011

(65) Prior Publication Data

US 2011/0308118 A1 Dec. 22, 2011

Related U.S. Application Data

(60) Provisional application No. 61/344,269, filed on Jun. 21, 2010.

(51) Int. Cl.
*A47G 1/06* (2006.01)
*A61G 17/00* (2006.01)

(52) U.S. Cl. ..... 40/124.5; 40/768; 40/722; 40/723; 40/724; 40/734

(58) Field of Classification Search ..... 40/711, 40/712, 721, 722, 723, 724, 732, 734, 768, 40/770, 737, 791, 790
See application file for complete search history.

(56) References Cited

U.S. PATENT DOCUMENTS

| | | | | |
|---|---|---|---|---|
| D46,454 | S | 9/1914 | Söderblom | |
| 2,817,915 | A | 12/1957 | Chatkin | |
| 3,992,793 | A * | 11/1976 | Candor | 40/533 |
| 4,250,640 | A * | 2/1981 | Culhane | 40/776 |
| 4,434,567 | A | 3/1984 | LeVeau | |
| 4,790,088 | A | 12/1988 | Morvant | |
| D364,965 | S | 12/1995 | Ilaria et al. | |
| 5,553,426 | A | 9/1996 | Ostergaard | |
| 5,634,667 | A | 6/1997 | Jordan | |
| 5,822,895 | A * | 10/1998 | Risdal | 40/124.5 |
| 6,012,245 | A * | 1/2000 | Squitieri | 40/735 |
| 6,067,748 | A | 5/2000 | Williams | |
| 6,341,437 | B1 | 1/2002 | Heiling et al. | |
| 6,349,494 | B1 * | 2/2002 | Haggarty-Robbins | 40/723 |
| 6,463,703 | B1 | 10/2002 | Mattis | |
| D467,436 | S | 12/2002 | Fink | |
| D470,433 | S | 2/2003 | Osawa | |
| 6,925,740 | B2 | 8/2005 | Shannon | |
| 7,305,781 | B1 | 12/2007 | Mowry | |
| 7,703,635 | B2 | 4/2010 | Smith | |
| 2002/0144440 | A1 | 10/2002 | Le Sueur | |
| 2002/0162262 | A1 * | 11/2002 | Angone, III | 40/727 |
| 2006/0162213 | A1 * | 7/2006 | Einarson | 40/765 |
| 2007/0220788 | A1 | 9/2007 | McCray | |
| 2008/0000125 | A1 * | 1/2008 | Chang | 40/723 |

FOREIGN PATENT DOCUMENTS

JP 2004306525 A 11/2004

* cited by examiner

*Primary Examiner* — Casandra Davis
(74) *Attorney, Agent, or Firm* — Richard C. Litman

(57) ABSTRACT

The memorial display is a retainer and display for funereal and memorial related items, such as obituary pages, sympathy cards, funeral flowers and the like. The memorial display includes a page retainer for receiving a display page, such as an obituary page. A transparent holder is provided for receiving the page retainer and securing the display page therein. A face plate, such as a memorial placard, is secured to a front face of the transparent holder. A framing mat, having opposed front and rear faces and a central cutout portion formed therethrough, is positioned against the transparent front face of the transparent holder for bordering the face plate. A frame member receives the page retainer, the transparent holder, the face plate and the framing mat such that the face plate is displayed through the front end of the frame member and the display page is displayed through the rear end.

20 Claims, 5 Drawing Sheets

MEMORIAL DISPLAY

CROSS-REFERENCE TO RELATED APPLICATION

This application claims the benefit of U.S. Provisional Patent Application Ser. No. 61/344,269, filed Jun. 21, 2010.

BACKGROUND OF THE INVENTION

1. Field of the Invention

The present invention relates to display devices, and particularly to a memorial display to commemorate a person who has passed away that can be used to permanently retain items in remembrance of the departed.

2. Description of the Related Art

When an individual passes away, it is customary to display the body of the individual in a casket at a funeral home, and thereafter the casket is buried. After the casket is buried, there is little left to remind the family of the burial ceremony and any associated memorial for the deceased. In order to provide a lasting memorial of the funeral service, some caskets include nameplates or other keepsakes mounted on the side or in a recess in the casket. The keepsakes are sometimes removable after the funeral service to be kept or displayed by the family.

Such nameplates, however, are typically in the form of conventional plaques. Any other keepsakes, such as funeral flowers, obituary copies, sympathy cards, or the like, are left free and uncontained. As time goes by, such items are often lost or misplaced. It would be desirable to provide a display that may be used at a memorial service and that may then be taken by the family, both as a display and as a retainer for holding such keepsakes in perpetuity.

Thus, a memorial display solving the aforementioned problems is desired.

SUMMARY OF THE INVENTION

The memorial display is a retainer and display for items in remembrance of the deceased, such as obituary pages, sympathy cards, funeral flowers, and the like. The memorial display includes a page retainer having opposed front and rear faces. The rear face has a recess formed therein for receiving a display page, such as an obituary page.

A transparent holder is provided for receiving the page retainer and securing the display page therein. Preferably, the transparent holder has a substantially U-shaped side cross-sectional contour, with an open upper end for receiving the page retainer, and a closed lower end. The transparent holder has transparent front and rear faces, with the rear face of the page retainer being aligned with the transparent rear face of the transparent holder such that the display page is visible through the transparent rear face of the transparent holder.

A detachable face plate, such as a memorial placard or the like, is secured to the transparent front face of the transparent holder. A framing mat having opposed front and rear faces and a central cutout portion formed therethrough is selectively, reversibly positioned against the transparent front face of the transparent holder. The rear face thereof is positioned against the transparent front face such that the detachable face plate is bordered thereby, with a rear face of the detachable face plate being releasably secured to the transparent front face, through the central cutout portion. A border of the framing mat is adapted for having ornamental indicia, ornamental fabric, or any other desired ornamentation or decoration formed thereon.

Additionally, a frame member having opposed front and rear ends and at least one sidewall is further provided. The front end preferably has a border formed therearound, similar to a picture frame, with the rear end being open. The frame member receives the page retainer, the transparent holder, the detachable face plate and the reversible framing mat such that the detachable face plate is displayed through a display opening formed through the border of the front end of the frame member. The display page and the rear face of the transparent holder are also displayed through the rear end of the frame member. The border of the front end of the frame member is adapted for having ornamental indicia, ornamental fabric, or any other desired ornamentation or decoration formed thereon.

In an alternative embodiment, a cover may be pivotally secured to the frame member for selectively covering the rear end thereof. Preferably, the cover has a recess formed therein for receiving memorial and funeral related items, such as funeral flowers or the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
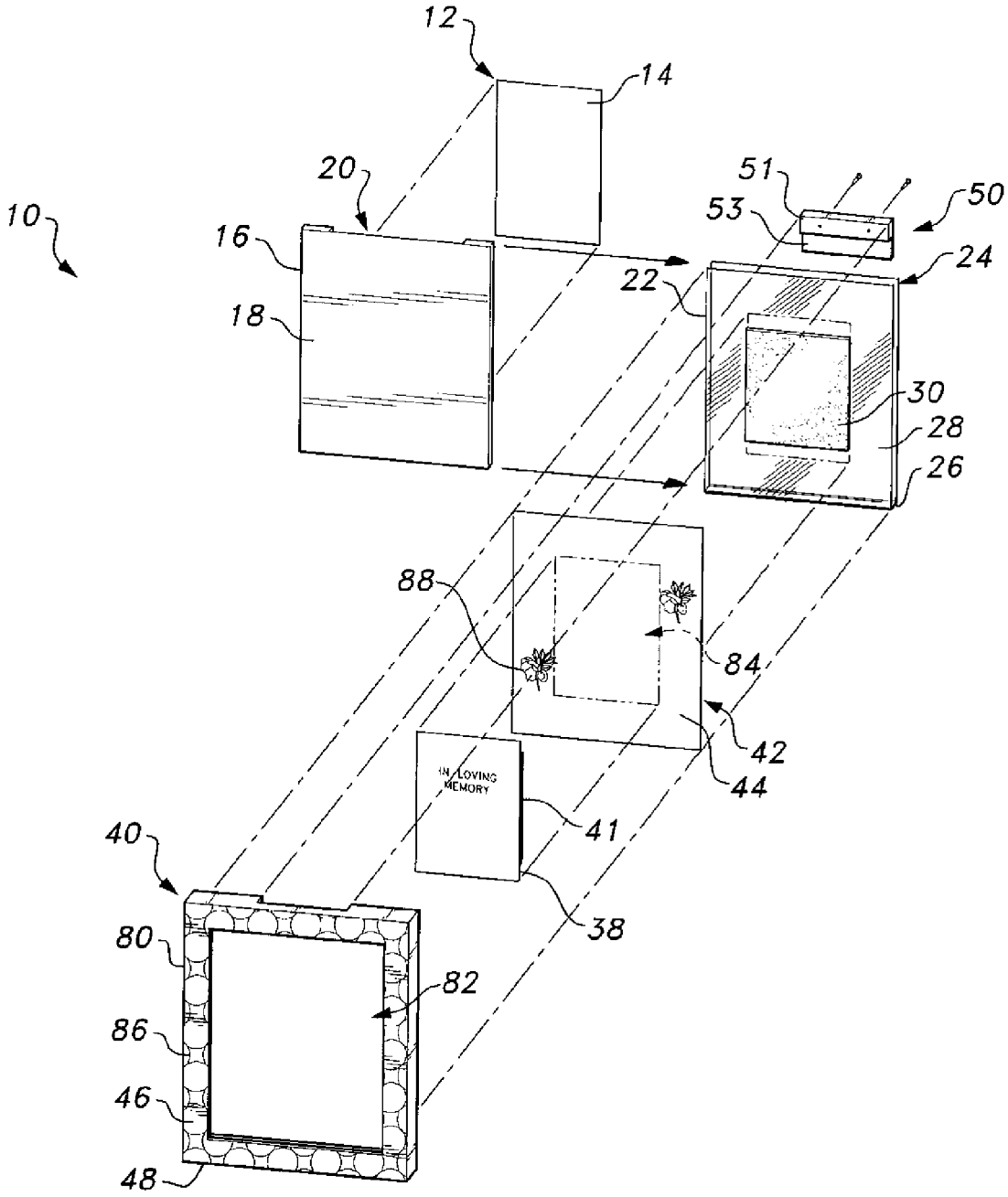
FIG. 2 is front exploded view of the memorial display of FIG. 1.
Figure 3:
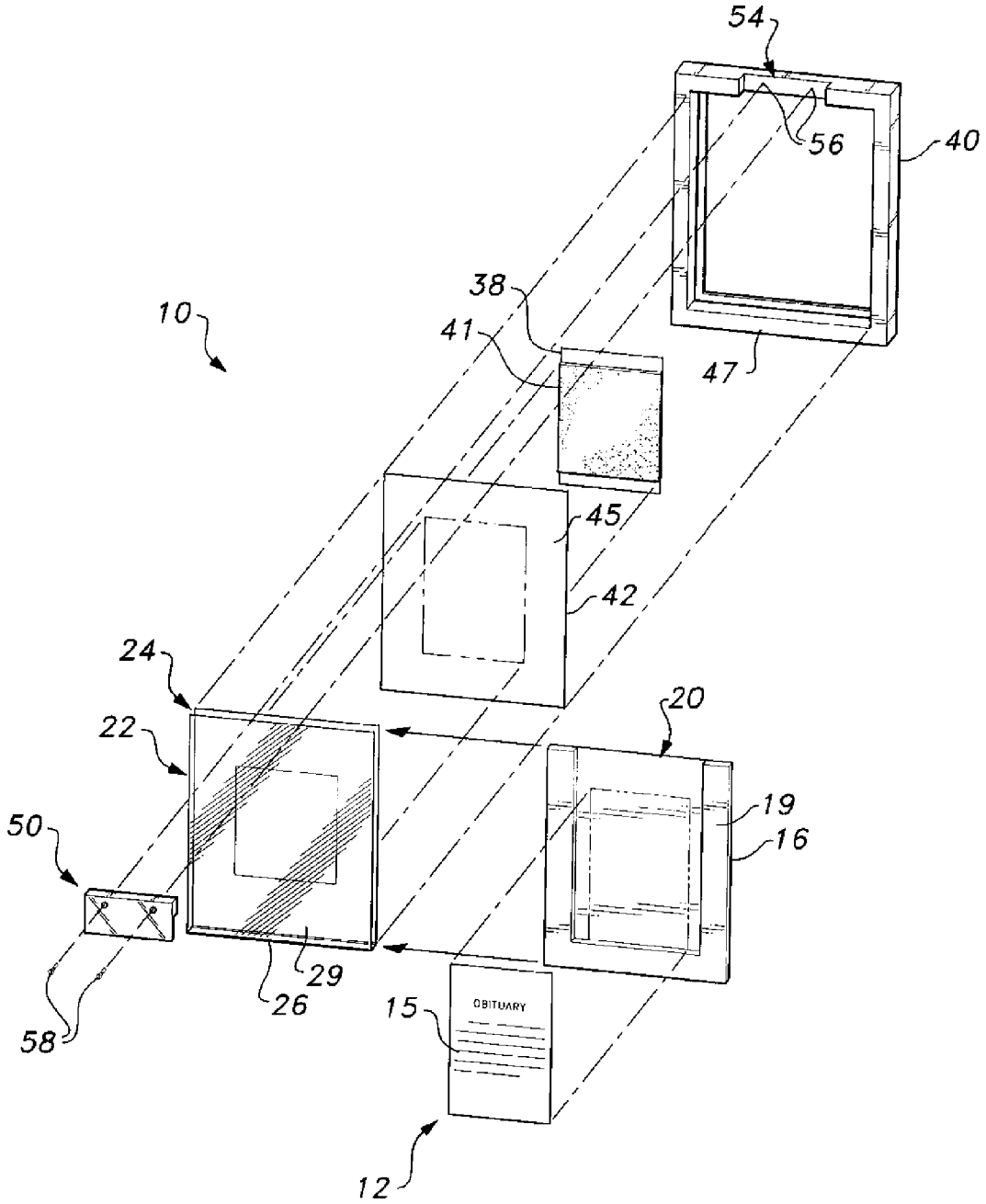
FIG. 3 is a rear exploded view of the memorial display of FIG. 1.

The memorial display 10 is a retainer and display for funereal and memorial related items, such as obituary pages, sympathy cards, funeral flowers and the like. As best shown in FIGS. 2 and 3, the memorial display 10 includes a page retainer 16 having opposed front and rear faces 18, 19, respectively, with a recess 20 being formed in the rear face 19 for receiving a display page 12, such as an obituary page. As shown in FIG. 3, the rear face 15 of display page 12 is visible through the rear face 19 of the page retainer 16, with the front face 14 of display page 12 facing the front face 18 of page retainer 16. Although page retainer 16 is shown as having a substantially rectangular contour, it should be understood that page retainer 16 may have any desired shape or relative dimensions. As will be described in greater detail below, memorial display 10 is reversible, illustrating the exemplary obituary page or a detachable placard, as well as providing reversible ornamental borders. Recess 20 is contoured and sized to match a conventional obituary page, and recess 20 may be customized to match the size and contour of display page 12. Page retainer 16 may be formed from any suitable material.

A transparent holder 22 is provided for receiving the page retainer 16 and securing the display page 12 therein. As shown, the transparent holder 22 is substantially U-shaped along the side, having an open upper end 24 for receiving the page retainer 16 and a closed lower end 26. Alternatively, the transparent holder 22 may be replaced by one or more sheets of plane glass or the like.

The transparent holder 22 has transparent front and rear faces 28, 29, respectively, with the rear face 19 of the page retainer 16 being aligned with the transparent rear face 29 of the transparent holder 22 so that the display page 12 is visible through the transparent rear face 29. Preferably, the substantially U-shaped transparent holder 22 has open sides, as shown. The transparent holder 22 may be formed from any suitable material, such as transparent plastic, glass or the like. Preferably, when glass is utilized, the glass is provided in the form of a single pane, which is positioned over the page retainer. In a preferred embodiment, the transparent holder is provided in single pane form and is made from transparent plastic material, e.g., from acrylic plastic.

A detachable face plate 38, such as a memorial placard or the like, is secured to the transparent front face 28 of the transparent holder 22. Preferably, detachable face plate 38 is releasably secured thereto, allowing for the exchange of multiple detachable face plates 38 for display. Any suitable type of releasable fastener may be used, such as exemplary magnets 30, 41, shown in FIG. 2. It should be understood that elements 30, 41 may both be magnets or, alternatively, one magnet may be provided with the other member being formed from a paramagnetic material, such as an iron plate, for example. The iron plate or magnet associated with transparent holder 22 may be mounted thereon, or formed therein, via any suitable means of attachment, molding or the like.

A framing mat 42, having opposed front and rear faces 44, 45, respectively, and a central cut-out portion 84 formed therethrough, is selectively, reversibly positioned against the transparent front face 28 of the transparent holder 22. The rear face 45 of framing mat 42 is positioned against the transparent front face 28 such that the detachable face plate 38 is bordered thereby, with a rear face of the detachable face plate 38 being releasably secured to the transparent front face 28, through the central cutout portion 84. The border of the framing mat 42 is adapted for having ornamental indicia 88, ornamental fabric, or any other desired ornamentation or decoration formed thereon. Framing mat 42 may be formed from any suitable material, such as cardboard, paper, paperboard, wood or the like.

Figure 1:
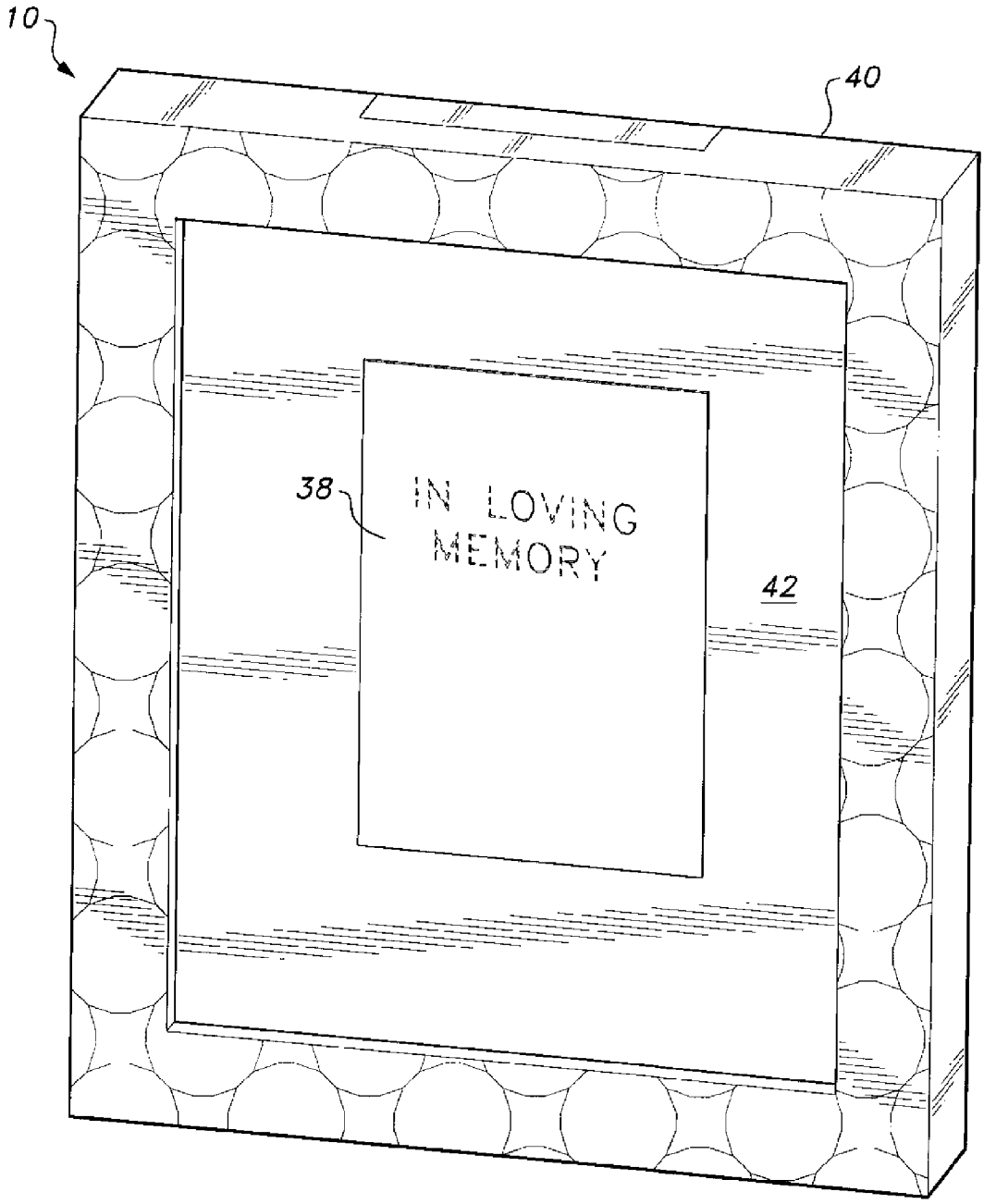
FIG. 1 is front perspective view of a memorial display according to the present invention.
Figure 4:
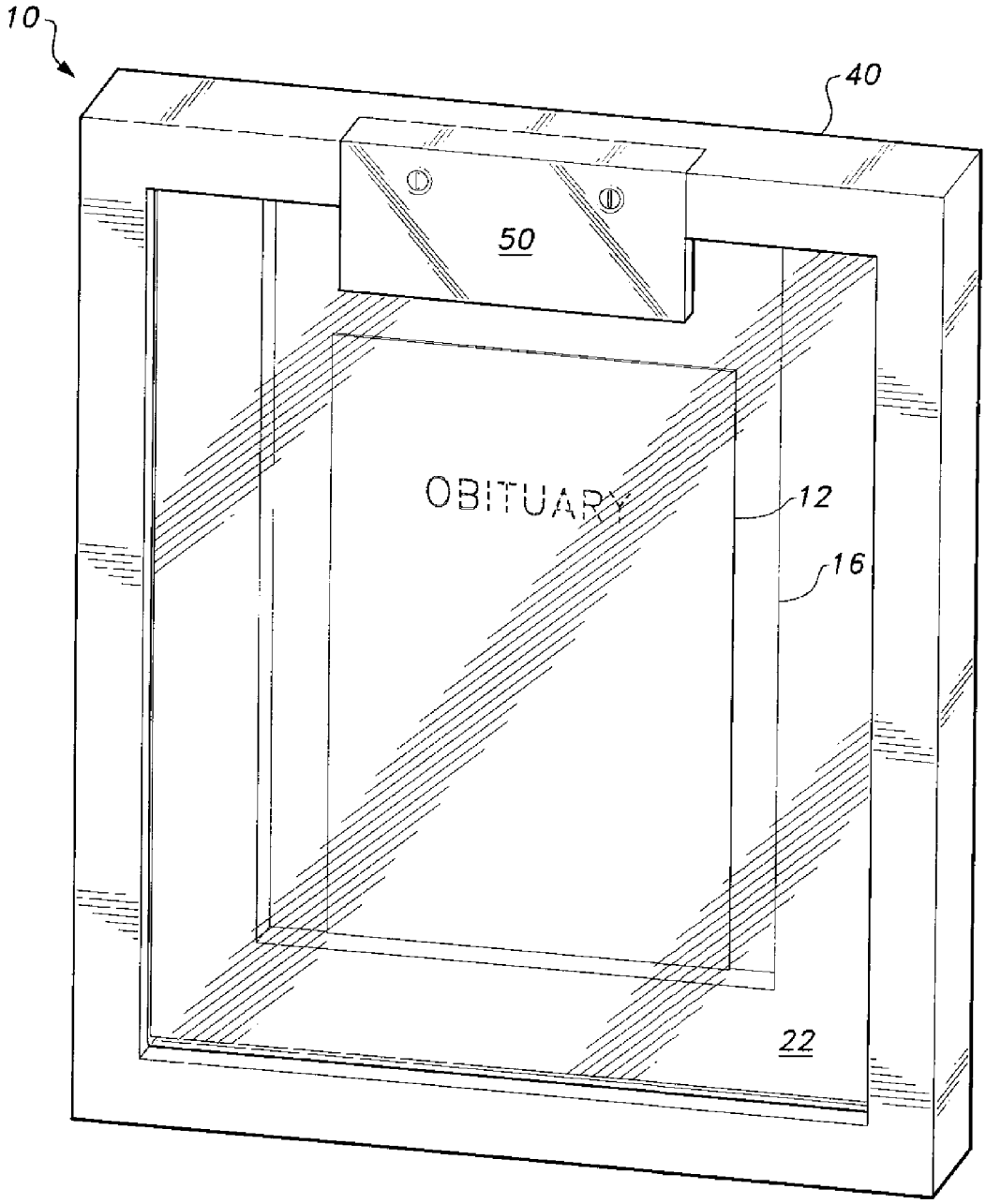
FIG. 4 is a rear perspective view of the memorial display of FIG. 1.

Additionally, a frame member 40, having opposed front and rear ends 46, 47, respectively, and at least one sidewall 48, is further provided. Although shown as being substantially rectangular, it should be understood that frame member 40 is shaped and sized to match (and receive) framing mat 42 and transparent holder 22. As shown, the front end 46 preferably has a border formed therearound, similar to a conventional picture frame, with the rear end 47 being open. The frame member 40 receives the page retainer 16, the transparent holder 22, the detachable face plate 38 and the framing mat 42 such that the detachable face plate 38 is displayed through a display opening 82 formed through the border 80 of the front end 46 of the frame member 40 (as shown in FIG. 1). The display page 12, along with the rear face of the transparent holder, is also displayed through the rear end 47 of the frame member 40, as shown in FIG. 4. The border 80 of the front end 46 of the frame member 40 is adapted for having ornamental indicia 86, ornamental fabric, or any other desired ornamentation or decoration formed thereon. Frame member 40 may be formed from any desired material, such as wood, metal, plastic or the like.

Additionally, a placard 50 may further be secured to the rear end 47 of frame 40. As shown in FIG. 3, the rear end 47 has a recess 54 formed in a top end thereof. A retaining portion 51 (shown in FIG. 2) of placard 50 is received within recess 54, such that display portion 53 overhangs an upper portion of the display page 12. The placard may have indicia formed on the display portion 53, such as a name or a statement regarding the object of the memorial. As shown in FIG. 3, a set of screws 58 or the like may be provided for securing the placard 50 to frame member 40 via apertures 56, 60. It should be understood that placard 50 may be secured to frame member 40 by any suitable type of fixtures or other alternative means of attachment. Placard 50 may be formed from any desired material, such as a material matching that of frame member 40, a traditional placard material, such as brass or bronze, or the like. Additional elements, such as wall hangers or the like, may be similarly attached to the frame, dependent upon the particular needs and desires of the user.

Figure 5:
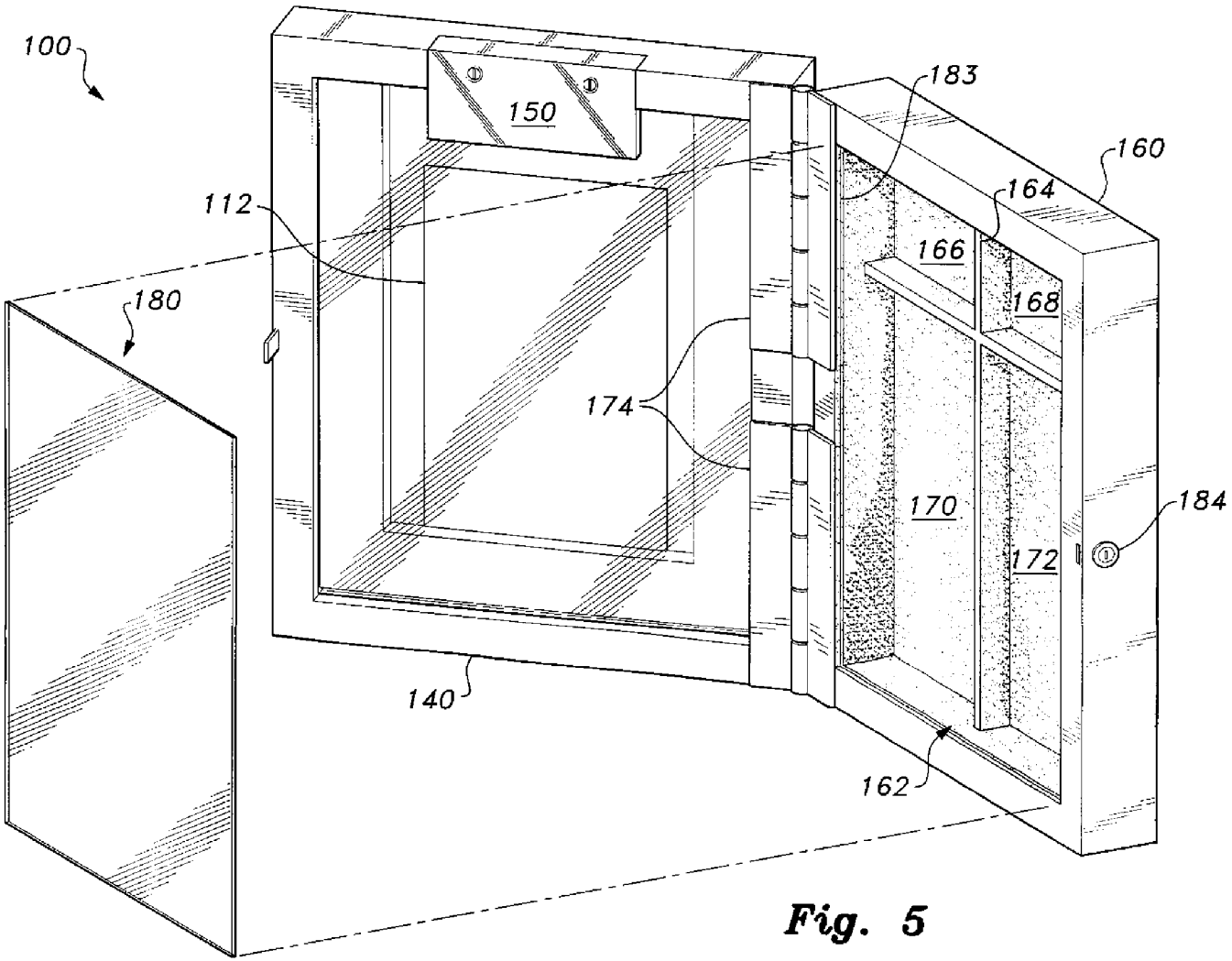
FIG. 5 is a rear, partially exploded view of an alternative embodiment of the memorial display according to the present invention.

In the alternative embodiment of FIG. 5, memorial display 100 includes a frame member 140, a placard 150, a display page 112, a page retainer (not shown), transparent holder (not shown), detachable face plate (not shown) and framing mat (not shown), similar to those described above with regard to memorial display 10. An additional lower wall 160 is pivotally secured to the frame member 140, as shown, for selectively covering the rear end thereof. Wall 160 may be secured to frame member 140 by hinges 174 or the like. Preferably, the wall 160 has a recess 162 formed therein for receiving memorial and funeral related items, such as the funeral flowers, literature, memorabilia or the like. A set of dividers 164 may be further provided for dividing the recess 162 into separate compartments 166, 168, 170, 172, as shown. Although a cross-shaped divider 164 is shown for dividing recess 162 into four such compartments, it should be understood that any suitable number of compartments may be defined therein by any desired configuration of dividers.

Lower wall 160 may be releasably locked to the rear end of frame member 140 by any suitable type of lock 184 (such as the exemplary cam lock shown), clasp or the like. Additionally, as shown, a separate panel or cover 180 may be provided for removably covering the recess 162 and retaining the memorial and funeral related items within compartments 166, 168, 170, 172. Preferably, a groove or slot 183 is defined in wall 160, allowing the panel 180 to be slid into place, though it should be understood that panel 180 may be releasably secured to wall 160 by any suitable type of releasable fastener. Panel 180 may be adapted for having ornamental indicia formed thereon or for displaying additional material, such as additional sympathy cards or the like.

It is to be understood that the present invention is not limited to the embodiments described above, but encompasses any and all embodiments within the scope of the following claims.

I claim:

1. A memorial display, comprising:

a page retainer having opposed front and rear faces, the rear face having a recess formed therein for receiving a display page;

a transparent holder receiving the page retainer and securing the display page therein, the transparent holder having transparent front and rear faces, the rear face of the page retainer being aligned with the transparent rear face of the transparent holder;

a detachable face plate attached to the transparent front face of the transparent holder;

a framing mat having opposed front and rear faces, the mat having a central cut-out portion, the rear face of the framing mat being selectively and reversibly positioned against the transparent front face of the transparent holder so that the detachable face plate is bordered thereby, the detachable face plate having a rear face releasably attached to the transparent front face of the transparent holder through the central cutout portion; and a frame member having opposed front and rear ends and at least one sidewall, the frame member receiving the page retainer, the transparent holder, the detachable face plate, and the framing mat so that the detachable face plate is displayed through a display opening formed through the front end of the frame member and the display page is displayed through the rear end of the frame member.

2. The memorial display as recited in claim 1, further comprising means for releasably securing said detachable face plate to the transparent front face of said transparent holder.

3. The memorial display as recited in claim 2, wherein said transparent holder is substantially U-shaped.

4. The memorial display as recited in claim 2, wherein said frame member has a placard recess defined in the at least one sidewall for releasably receiving a placard.

5. The memorial display as recited in claim 4, wherein the placard recess is formed in the rear end of said frame member.

6. The memorial display as recited in claim 5, further comprising a cover pivotally attached to the frame member for selectively covering the rear end thereof.

7. A memorial display, comprising:

a page retainer having opposed front and rear faces, the rear face having a recess formed therein for receiving a display page;

a transparent holder receiving the page retainer and securing the display page therein, the transparent holder having transparent front and rear faces, the rear face of the page retainer being aligned with the transparent rear face of the transparent holder;

a detachable face plate attached to the transparent front face of the transparent holder;

a framing mat having opposed front and rear faces, the mat having a central cutout portion, the rear face of the framing mat being selectively and reversibly positioned against the transparent front face of the transparent holder so that the detachable face plate is bordered thereby, the detachable face plate having a rear face releasably attached to the transparent front face of the transparent holder through the central cutout portion;

a frame member having opposed front and rear ends and at least one sidewall, the frame member receiving the page retainer, the transparent holder, the detachable face plate and the framing mat so that the detachable face plate is displayed through a display opening formed through the front end of the frame member and the display page is displayed through the rear end of the frame member; and a cover pivotally attached to the frame member selectively covering the rear end thereof.

8. The memorial display as recited in claim 7, further comprising means for releasably attaching said detachable face plate to the transparent front face of said transparent holder.

9. The memorial display as recited in claim 8, wherein said transparent holder is substantially U-shaped.

10. The memorial display as recited in claim 9, wherein said frame member has a placard recess defined in the at least one sidewall for releasably receiving a placard.

11. The memorial display as recited in claim 10, wherein the placard recess is formed in the rear end of said frame member.

12. The memorial display as recited in claim 11, wherein said cover defines a storage recess therein.

13. The memorial display as recited in claim 12, wherein the storage recess defined in said cover is divided into a plurality of compartments.

14. The memorial display as recited in claim 13, further comprising means for releasably locking said cover against the rear end of said frame member.

15. The memorial display as recited in claim 14, further comprising a removable panel selectively covering the storage recess.

16. A memorial display, comprising:

a page retainer having opposed front and rear faces, the rear face having a recess formed therein for receiving a display page;

a transparent holder receiving the page retainer and securing the display page therein, the transparent holder having transparent front and rear faces, the rear face of the page retainer being aligned with the transparent rear face of the transparent holder, the transparent holder being substantially U-shaped;

a detachable face plate attached to the transparent front face of the transparent holder;

a framing mat having opposed front and rear faces, the mat having a central cutout portion, the rear face of the framing mat being selectively and reversibly positioned against the transparent front face of the transparent holder so that the detachable face plate is bordered thereby, the detachable face plate having a rear face releasably attached to the transparent front face of the transparent holder through the central cutout portion, the framing mat having a border adapted for having ornamentation formed thereon; and a frame member having opposed front and rear ends and at least one sidewall, the frame member receiving the page retainer, the transparent holder, the detachable face plate and the framing mat so that the detachable face plate is displayed through a display opening formed through the border on the front end of the frame member and the display page is displayed through the rear end of the frame member, the border on the front end of the frame member being adapted for having ornamental indicia formed thereon.

17. The memorial display as recited in claim 16, further comprising means for releasably securing said detachable face plate to the transparent front face of said transparent holder.

18. The memorial display as recited in claim 17, wherein said frame member has a placard recess defined in the at least one sidewall for releasably receiving a placard.

19. The memorial display as recited in claim 18, wherein the placard recess is formed in the rear end of said frame member.

20. The memorial display as recited in claim 19, further comprising a cover pivotally attached to the frame member and selectively covering the rear end thereof, said cover defining a storage recess therein.

* * * * *